United States Patent [19]

Mochida et al.

[11] 4,455,588

[45] Jun. 19, 1984

[54] ELECTRONICAL UNLOCKING METHOD AND SYSTEM

[75] Inventors: Haruo Mochida, Yokohama; Keiichi Shimizu, Tokyo, both of Japan

[73] Assignees: Nissan Motor Company, Limited, Kanagawa; Kokusan Kinzoku Kogyo Co., Ltd., Tokyo, both of Japan

[21] Appl. No.: 373,285

[22] Filed: Apr. 29, 1982

[30] Foreign Application Priority Data

Apr. 30, 1981 [JP] Japan ..... 56-66012

[51] Int. Cl.[3] ..... E05B 49/00

[52] U.S. Cl. ..... 361/172; 340/543; 340/825.31; 307/10 AT; 70/278

[58] Field of Search ..... 361/172; 307/10 AT; 340/543, 825.31; 70/278

[56] References Cited

U.S. PATENT DOCUMENTS

| | | | |
|---|---|---|---|
| 3,587,051 | 6/1971 | Hovey | 340/543 |
| 3,593,816 | 7/1971 | Kazaoka | 70/264 |
| 3,633,167 | 1/1972 | Hedin | 340/164 |
| 3,691,396 | 9/1972 | Hinrichs | 307/40 |
| 3,710,316 | 1/1973 | Kromer | 340/63 |
| 3,751,718 | 8/1973 | Hanchett, Jr. | 361/172 |
| 3,754,213 | 8/1973 | Morroni et al. | 361/172 |
| 3,764,859 | 10/1973 | Wood | 307/10 AT |
| 3,812,403 | 5/1974 | Gartner | 307/10 AT |
| 3,831,065 | 8/1974 | Martin | 361/172 |
| 3,871,474 | 3/1975 | Tomlinson et al. | 180/112 |
| 3,878,511 | 4/1975 | Wagner | 340/543 |
| 3,885,408 | 5/1975 | Clark, Jr. | 70/278 |
| 3,893,073 | 7/1975 | Angello | 361/172 |
| 4,189,712 | 2/1980 | Lemelson | 340/542 |
| 4,197,524 | 4/1980 | Salem | 340/543 |
| 4,205,325 | 5/1980 | Haygood et al. | 307/10 R |
| 4,206,491 | 6/1980 | Ligman | 361/172 |
| 4,222,088 | 9/1980 | Burton | 361/172 |
| 4,249,245 | 2/1981 | Nakanashi | 364/710 |

FOREIGN PATENT DOCUMENTS

| | | |
|---|---|---|
| 47486 | 11/1982 | European Pat. Off. . |
| 2913955 | 9/1980 | Fed. Rep. of Germany . |

*Primary Examiner*—George H. Miller, Jr.
*Assistant Examiner*—Derek S. Jennings
*Attorney, Agent, or Firm*—Lowe, King, Price & Becker

[57] ABSTRACT

An electronical locking/unlocking system by which a door can be unlocked when a single switch is depressed repeatedly by an operator in time with a musical rhythm which he knows or in accordance with a Morse-type code. The electronical locking/unlocking system according to the present invention comprises a single switch for generating a predetermined series of on-time interval and off-time interval signals, a first counting unit for counting the on-time intervals, a second counting unit for counting the off-time intervals, a memory unit for previously storing reference ratios of on-time intervals to off-time intervals, a calculating unit for dividing the counted on-time intervals by the counted off-time intervals, a comparating unit for comparing the calculated values with the reference values, a third counting unit for counting the number of accurate on/off ratios up to a predetermined number, and an unlocking actuator.

27 Claims, 4 Drawing Figures

SW
1st
DELAY
1st TIMER
4th
3rd
5th
R 3rd CNT
SUB
3rd
1st ROM
2nd ROM
3rd ROM
1st COMP
2nd COMP
3rd COMP
2nd TIMER
5th
1st LATCH
1st GATE
CAL (X/Y)
2nd GATE
2nd LATCH
R 1st CNT
1st
R 2nd CNT
2nd
2nd
4th
5th
R 4th CNT
6th
3rd TIMER
UNLOCK ACTUATOR
3rd
DIVIDER

START
410
IS SWITCH ON ?
YES
NO
450
INCREMENT X
420
INCREMENT Y
460
X = 1 ?
YES
NO
END
470
STEP COUNTER =-1 ?
YES
NO
480
INCREMENT STEP COUNTER
END
430
Y = 1 ?
NO
YES
440
STORE AND RESET X
END
490
STORE AND RESET Y
500
X÷Y
510
X÷Y< MAX ?
NO
YES
520
RESET STEP COUNTER TO-1
530
X÷Y> MIN ?
NO
YES
540
INCREMENT STEP COUNTER
550
STEP COUNTER = N?
NO
END
YES
560
OUTPUT DOOR UNLOCK SIGNAL
END

ELECTRONICAL UNLOCKING METHOD AND SYSTEM

BACKGROUND OF THE INVENTION

1. Field of the Invention

The present invention relates generally to an electrical locking/unlocking system and more specifically to an electronic unlocking system by which a door can be unlocked when a single switch is depressed repeatedly by a driver in time with a musical rhythm which he knows, for instance, or in accordance with a Morse-type code.

2. Description of the Prior Art

As is well-known, electrical locking/unlocking devices have been proposed by which, for instance, a door can be locked or unlocked by depressing a plurality of push-button switches in a predetermined sequence; however, in this type of electrical locking/unlocking devices, since a switch board on which a plurality of push-button switches are arranged must be disposed near the door, and further since the different push-button switches must be depressed repeatedly, there exist such shortcomings that there are relatively few places where the switch board can be mounted and the repeated operations of different push-button switches are troublesome because the operator must repeatedly locate the appropriate switches. In order to overcome these problems, although it is possible to lock or unlock a door by simply depressing a single switch, this type of electrical door locking/unlocking device is not practical from the standpoint of crime prevention because a thief can easily unlock the door.

SUMMARY OF THE INVENTION

With these problems in mind therefore, it is the primary object of the present invention to provide an electronic locking/unlocking system by which a door can be unlocked when a single switch is depressed repeatedly in time with a musical rhythm, for example, or in accordance with a Morse-type code;

To achieve the above-mentioned object, the electronic locking/unlocking system according to the present invention comprises a switch for generating a predetermined unlocking signal including a series of on-time intervals and off-time intervals, a first counting unit for counting the on-time intervals, a second counting unit for counting the off-time intervals a memory unit for previously storing reference ratios of on-time intervals to off-time intervals, a calculating unit for dividing the counted on-time intervals by the counted off-time intervals, a comparing unit for comparing the calculated values with the reference values, a third counting unit for counting the predetermined number of compared values, and an unlocking actuator for operating an unlocking mechanism in response to an unlocking command signal outputted from the third counting unit.

BRIEF DESCRIPTION OF THE DRAWINGS

The features and advantages of the method and system of the electrical locking/unlocking system according to the present invention will be more clearly appreciated from the following description of the preferred embodiment of the invention taken in conjunction with the accompanying drawings in which like reference numerals designate the same or similar elements or sections throughout the figures thereof and in which.

DETAILED DESCRIPTION OF THE PREFERRED EMBODIMENTS

Figure 1:
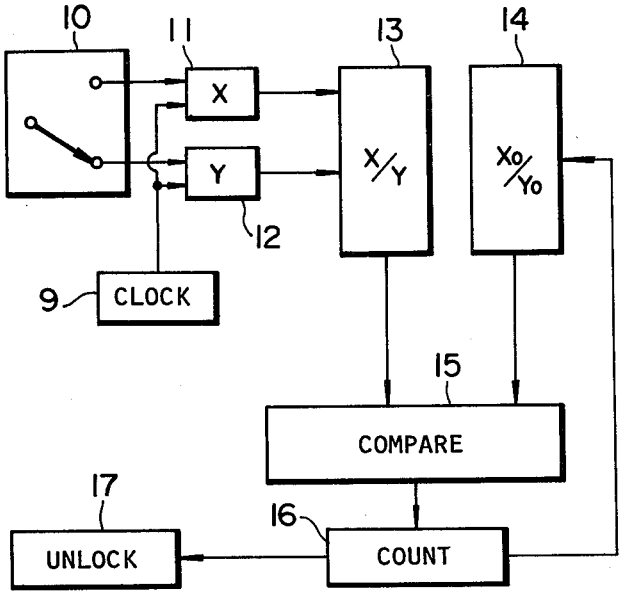
FIG. 1 is a basic functional block diagram of the electrical locking/unlocking system according to the present invention.

The method of the present invention will be explained with reference to FIG. 1. A switch 10, preferably of the quick-return, spring-loaded type, has two contact positions which produce distinct electrical signals, i.e. the depressed position produces an "on" or "X" signal while the released position produces an "off" or "Y" signal. A clock pulse generator 9 continuously outputs a constant-frequency clock pulse train. The duations of the "on" and "off" signals are counted with reference to the clock pulses in blocks 11 and 12 respectively to produces count values X and Y respectively. That is, while switch 10 is depressed, clock pulses are counted in block 11. Then when switch 10 is released, clock pulses are counted in block 12 until switch 10 is depressed again. At that time, the values X and Y are transferred to block 13, and the previous counts in blocks 11 and 12 are reset to start counting signal durations again. In block 13, the value X is divided by the value Y to obtain a ratio value X/Y indicative of the relative lengths of the on and off intervals. This ratio X/Y is compared in block 15 to a predetermined correct ratio value Xo/Yo held in block 14. If ratio X/Y equals, or falls within a predetermined tolerance of, ratio Xo/Yo, block 15 increments a successful-step counter 16; otherwise, block 15 resets counter 16 to restart the unlocking-code input procedure. The value of counter 16 is used to select one of a plurality of predetermined ratio values Xo/Yo corresponding to the current step ("step" means a single switch depress-release cycle). When the value of counter 16 reaches the predetermined number of code-input steps, counter 16 signals a door lock unlocking actuator 17 to unlock the door.

This method can be seen to permit door unlocking by way of rhythmic depression and release of a single switch. The ratiometric comparison of on and off intervals is especially well suited to Morse-type codes or simple musical rhythms.

Figure 2:
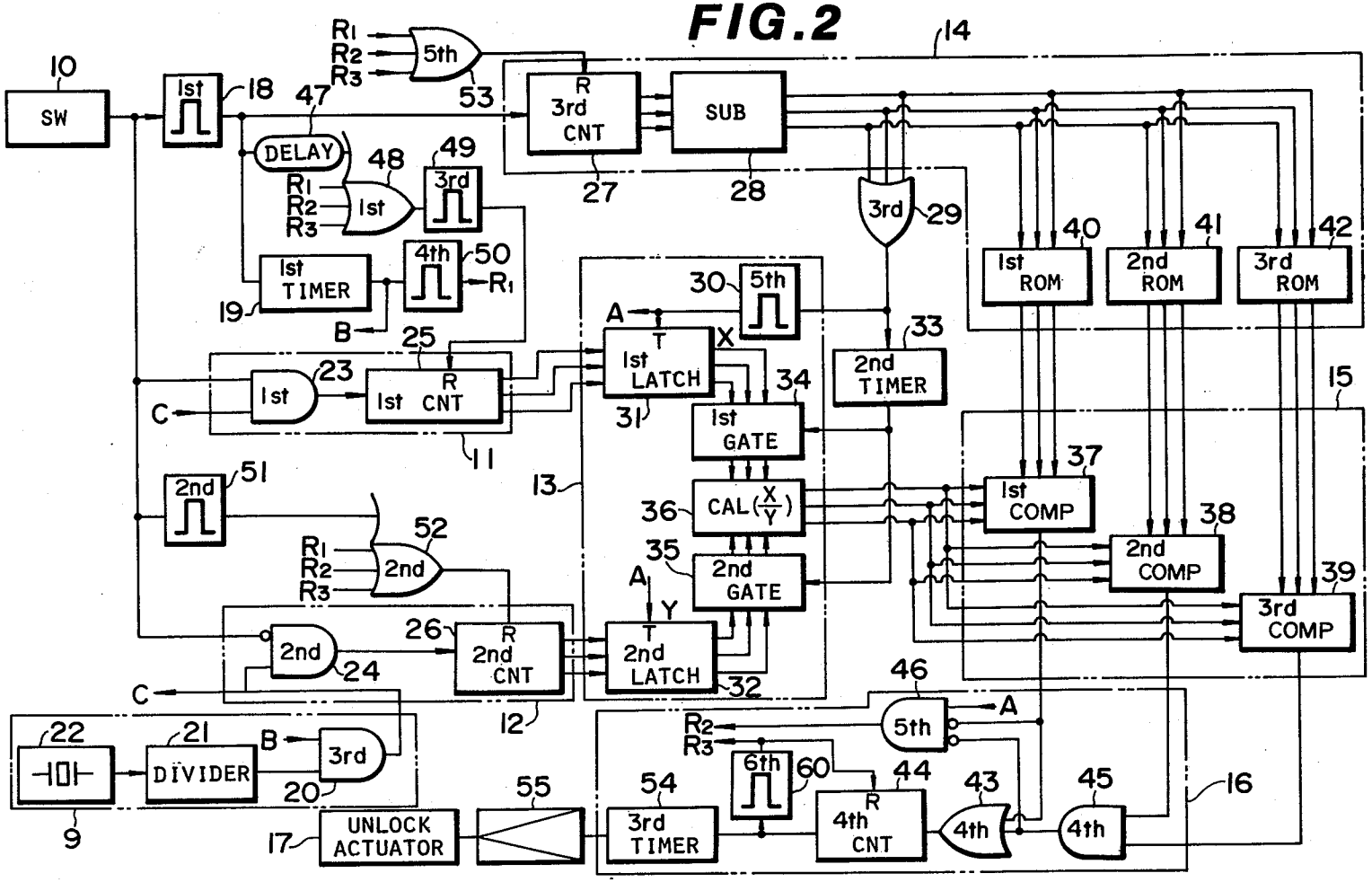
FIG. 2 is a schematic block diagram of a first embodiment of the electrical locking/unlocking system according to the present invention.

Systems adapted to execute the method of the present invention can be variously embodied for use on automotive vehicle. FIG. 2 shows a first embodiment in a functional block diagram of an electronic circuit.

The system according to this embodiment of the present invention comprises in general a switch 10 for generating an unlocking signal when depressed manually, a first counting unit 11 for counting time intervals during which the switch 10 is kept turned on, a second counting unit 12 for counting time intervals during which the switch 10 is kept turned off, a calculating unit 13 for dividing the numerical values X output from the first counting unit 11 by the numerical values (Y) output from the second counting unit 12, a memory unit 14 for storing reference numerical values Xo/Yo, a comparing unit 15 for comparing the value X/Y output from the calculating unit 13 with the value Xo/Yo output from the memory unit 14, a third counting unit 16 for counting the number of signals output from the comparing unit 15, a clock signal generating circuit 9, an unlocking actuator 17 such as a solenoid or motor for unlocking, for instance, a door, etc.

The switch 10 is a push-button type switch or another known switch, which can output switch-on signals and switch-off signals.

First, the operation of the first counting unit 11 for counting time intervals during which the switch 10 is kept on will be described hereinbelow.

When the switch 10 is turned on, a H-voltage level signal is applied to a first one-shot multivibrator 18. Since the first one-shot multivibrator 18 is triggered by the leading edge of the H-voltage level signal generated when the switch 10 is turned on, the first timer 19 starts counting time in response to the output signal from the multivibrator 18 and outputs a H-voltage level signal for a predetermined period of time long enough to include the entire code-input procedure. The output of first timer 19 is applied to one input terminal of an AND gate 20 (designated in FIG. 2 as a third AND gate) in the clock signal generating circuit 9, in which a high-frequency clock pulse signal is generated by a reference oscillator 22 and divided into an appropriate low-frequency clock pulse signal by a frequency divider 21. Since this low-frequency clock pulse signal is applied to the other input terminal of the third AND gate 20, the third AND gate 20 passes the low-frequency clock pulse signal only while the first timer 19 generates a H-voltage level signal. Since the output terminal of the third AND gate 20 is connected to one input terminal of an AND gate 23 (designated in FIG. 2 as a first AND gate) and the output terminal of the switch 10 is connected to the other input terminal of the first AND gate 23, the first AND gate 23 passes the divided clock pulse signals when the switch 10 is on and the first timer 19 is outputting a H-voltage level signal. The number of clock pulse signals outputted from the first AND gate 23 is counted by a first counter 25.

On the other hand, since the H-voltage level signal from the first one-shot multivibrator 18 is applied to a delay circuit 47 and the output of this delay circuit 47 is applied to the reset terminal R of the first counter 25 via a first OR gate 48 and a third one-shot multivibrator 49 (shown in FIG. 2 as a third one shot multivibrator), the first counter 25 is reset to the original state after a predetermined period of time determined by the delay circuit 47. This is because the first counter 25 must be reset after the on-time interval of the switch 10 has been counted and the counted value has been shifted into a first latch 31 (described later).

Next, the operation of the second counting unit 12 for counting time intervals during which the switch is kept off will be described.

When the switch 10 is turned off, a L-voltage level signal is applied to the one inverted input terminal of the second AND gate 24. Since the first timer 19 is still outputting a H-voltage level signal to the one input terminal of the third AND gate 20 and since the output terminal of the third AND gate 20 is connected to the other input terminal of a second AND gate 24, the second AND gate 24 passes the divided clock pulse signals when the switch 10 is off. Therefore, the number of clock pulse signals output from the second AND gate 24 is counted by a second counter 26.

When the switch 10 is turned on, a H-voltage level signal is applied to the second one-shot multivibrator 51. Since this second one-shot multivibrator 51 is triggered by the leading edge of this H-voltage level signal from the switch 10, the output signal from the one-shot multivibrator 51 resets the second counter 26 via a second OR gate 52.

Thirdly, the operation of the memory unit 14 for storing predetermined values will be described.

The H-voltage level from the first one-shot multivibrator 18 is applied to third counter 27 when the switch 10 is turned on. In response to this output signal from the multivibrator 18, the third counter 27 outputs 3-bit address signals corresponding to the number of the current step. Although the address signals from counter 27 start with 1, 2, 3 . . . , a subtracter 28 subtracts one from these address numbers. Therefore, when the switch 10 is first turned on, the third counter 27 outputs a signal indicative of 1, but the subtracter 28 outputs a signal indicative of 0. When the switch 10 is depressed a second time, although the third counter 27 outputs a signal indicative of 2, the subtracter 28 outputs a signal indicative of 1. The reason why one is subtracted is that the first count values X and Y are not used until the end of the first step and the beginning of the second.

Further, in this embodiment, since the addresses are designated by three binary digits, three connecting wires are shown between the elements.

This address signal is applied to three read-only memories 40, 41 and 42 to access the stored numerical values corresponding to these address numbers. In the first read-only memory 40, the reference ratios Xo/Yo of on-time interval to off-time interval of the switch 10 are previously stored according to the respective address numbers. In the second read-only memory 41, upper limits of the numerical reference values Xo/Yo are previously stored according to the respective address numbers. In the third read-only memory 42, lower limits of the numerical reference values Xo/Yo are previously stored according to the respective address numbers.

In the memory unit 14, in some cases, it may be possible to omit some of the above-mentioned read-only memories 40, 41 and 42. That is to say, it may be sufficient to use only the first read-only memory 40 to store reference values or the second and third read-only memories 41 and 42 to store upper and lower limits.

Fourthly, the operation of the calculating unit 13 for dividing the signal X output from the first counting unit 11 by the signal Y output from the second counting unit 12 will be described below.

A third OR-gate 29 takes the logical OR of the three address bit lines so that after the first step, the OR-gate outputs a H-voltage signal. The H-voltage level signal output from the third OR gate 29 is applied to a fifth one-shot multivibrator 30 to trigger it. The triggered output signal from this multivibrator 30 is applied to the respective shift terminals T of a first latch 31 and a second latch 32, so that the numerical values X and Y counted by the first and second counters 25 and 26 are shifted to these latches 31 and 32 and recorded therein.

On the other hand, since the H-voltage level signal output from the third OR gate 29 is also applied to a second timer 33, the timer 33 starts outputting a signal for a predetermined period of time to open a first gate 34 and a second gate 35 which usually consist of transistors. Therefore, the numerical values recorded in the first and second latches 31 and 32 are applied to a calculator 36 (divider) in order to execute a division calculation X/Y, in which the dividend X is the numerical value counted by the first counter 25 (the time interval during which the switch 10 is on) and the divisor Y is the numerical value counted by the second counter 26 (the time interval during which the switch is off).

Fifthly, the operation of the comparing unit 15 which compares the value X/Y output from the calculating unit 13 to the value output from the memory unit 14 will be explained.

The numerical value X/Y obtained by the calculator 36 is applied to a first comparator 37, a second comparator 38, and a third comparator 39. The first comparator 37 compares the value X/Y from the calculator 36 with the value from the first read-only memory 40, that is, determines whether or not the calculated on-to-off ratio agrees with the reference ratio stored in the first memory 40. If the values agree the first counter 37 outputs a H-voltage level signal. The second comparator 38 compares the value X/Y from the calculator 36 with the value from the second read-only memory 41, that is, determines whether or not the calculated on-to-off ratio is below the reference upper limit value. If below, the second counter 38 outputs a H-voltage level signal. The third comparator 39 compares the value X/Y from the calculator 36 with the value from the third read-only memory 42; that is, it determines whether the calculated on-to-off ratio exceeds the lower limit of the reference value. If so, the third counter 39 outputs a H-voltage level signals.

In the comparing unit 15, in some cases, it may be possible to omit any one or any two of the above-mentioned comparators 37, 38 and 39, according to the kinds of reference ratio values stored in the memory uhit 14.

Sixthly, the operation of the third counting unit 16 which counts signals indicative of correctly-executed code steps output from the comparating unit 15 will be described.

When the first comparator 37 outputs a H-voltage level signal, that is, when the calculated on-to-off ratio agrees with the reference value, this output signal increments a fourth counter 44 via a fourth OR gate 43. When the second and third comparators 38 and 39 both output H-voltage level signals, that is, when the calculated on-to-off ratio lies between the upper and lower reference limits, these two output signals are applied to a fourth AND gate 45 and thereby increment the fourth counter 44 via the fourth OR gate 43.

Since the signals from the respective comparators 37, 38 and 39 are applied to the fourth counter 44 whenever a coding step has been correctly executed, the count in of counter 44 equals the number of completed steps. If the count in of counter 44 reaches a predetermined number, the fourth counter 44 outputs a signal to start a third timer 54. In response to a H-voltage signal from the timer 54, an unlocking actuator 17 is activated for a predetermined period of time to operate an unlocking mechanism (not shown).

Further, in this embodiment, although the fourth counter 44 is automatically reset by the output signal from the fourth counter itself, since the third timer 54 maintains a H-voltage output for a predetermined period of time, the unlocking actuator will be energized for a sufficiently long time.

Lastly, the reset operations will be described below.

Whenever the first timer 19 stops operating after the entire code-input procedure, the fourth one-shot multivibrator 50 is triggered by the trailing edge of the output signal from the timer 19 to output a first reset signal $R_1$.

In response to this reset signal $R_1$, the first, second and third counter 25, 26 and 27 are all reset via the first, second and fifth OR gates 48, 52 and 53.

When the first comparator outputs a L-voltage level signal, that is, when the calculated on-to-off ratio does not agree with the reference value, this signal is applied to an inverted input terminal of a fifth AND gate 46. Similarly, when either of the second and third comparators 38 and 39 outputs a L-voltage level signal, that is, when the calculated on-to-off ratio does not lie between the upper and lower limits, a L-voltage signal is applied to another inverted input terminal of the fifth AND gate 46 via the fourth AND gate 45.

Since the triggered output signal from the fifth one-shot multivibrator 30 is also applied to the input terminal of the fifth AND gate 46 (this indicates that the switch 10 is turned on), the fifth AND gate 46 outputs a second reset signal $R_2$ indicative of the state where the switch 10 is depressed to start a new step but the on-to-off ratio is not correct or does not lie within a predetermined range. In response to this second reset signal $R_2$, the first, second and third counters 25, 26 and 27 are all reset to the original state via the first, second, and fifth OR gates 48, 52 and 53, respectively.

When the fourth counter 44 outputs a signal to start the third timer 54, the signal is also applied to a sixth one-shot multivibrator 60 to output a third reset signal $R_3$ indicative of the fact that the unlocking operation has been completed. In response to this third reset signal $R_3$, the first, second, third and fourth counters 25, 26, 27 and 44 are all reset to the original state via the first, second, and fifth OR gates 48, 52 and 53 (only the fourth counter 44 is reset directly).

The reference ratios of on-time to off-time to be stored in the read-only memory units 40, 41 and 42 may represent, for instance, a musical rhythm. Therefore, if the driver depresses the switch 10 in time with a brief piece of music which the driver knows, it is possible to unlock, for instance, the vehicle doors of his own automotive vehicle while preventing unauthorized entry.

When the switch 10 is rhythmically depressed the first counter 25 is reset by the first switch-on signal and simultaneously the on-time interval is counted by the first counter 25 via the first AND gate 23. Similarly, the second counter 26 is reset by the first switch-off signal and the off-time interval is counted by the second counter 26 via the second AND gate 24.

When the second on-time signal is outputted, the subtracter 28 generates a signal to be applied to the shift terminals T of the first and second latches 31 and 32 via the third or gate 29 and the fifth one-shot multivibrator 30. Therefore, the counted values in the first and second counters 25 and 26 are shifted and recorded in the latches 31 and 32. Since the second timer 33 also starts operating for a predetermined period of time to open the first and second gates 34 and 35, the calculator 36 calculates the ratio of two counted values (on-time/off-time) and this calculated value is fed to the comparators 37, 38 and 39. If the calculated value agrees with the reference value or lies within a predetermined range, the comparators 37, 38 and 39 output respective signals to increment the value in the fourth counter 44.

The reference values or the predetermined ranges are output from the first, second, and third read-only memory units 40, 41 and 42 to the first, second and third comparators 37, 38 and 39, respectively in accordance with the respective address designation signals output from the third counter 27 via the subtracter 28.

Whenever the switch 10 is depressed by an operator in time with a predetermined musical rhythm, the fourth counter 44 is advanced incrementally, and when the counter 44 has counted up to a predetermined value, the unlocking actuator 17 is activated in response to the output signal from the fourth counter 44.

The unlocking actuator 17 can also be activated when the switch 10 is depressed in accordance with a Morse-type code.

Figure 3:
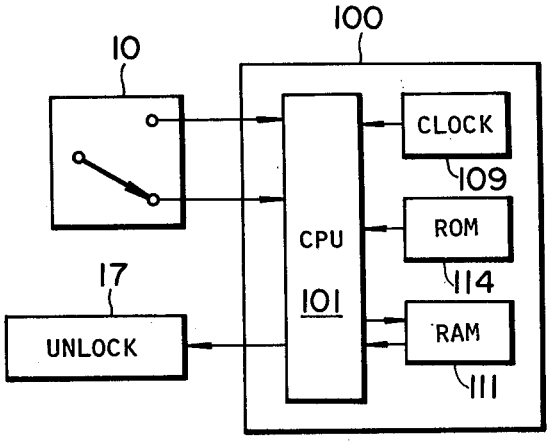
FIG. 3 is a schematic block diagram of a second embodiment of the electrical locking/unlocking system according to the present invention.
Figure 4:
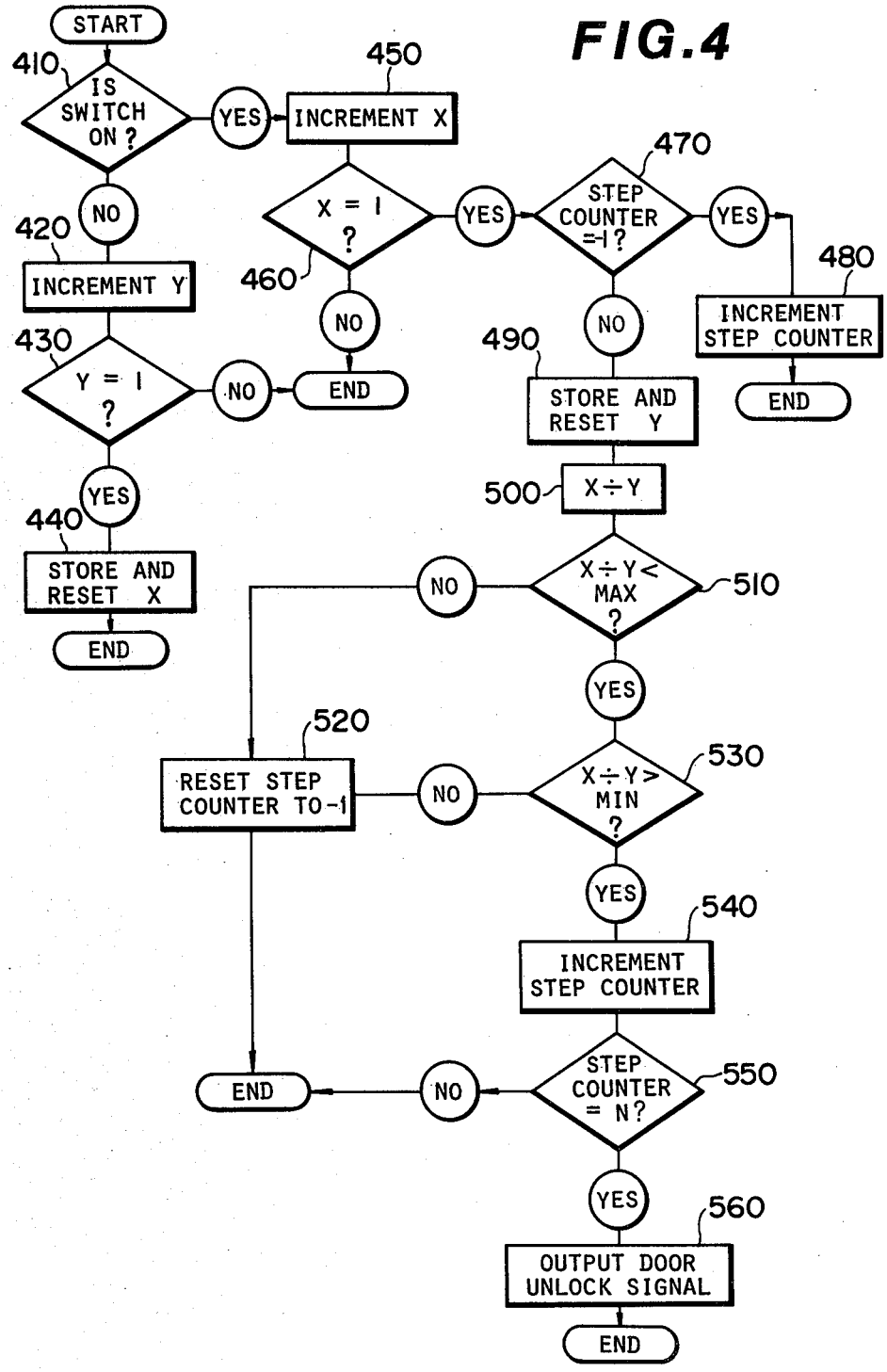
FIG. 4 is a flowchart of an exemplary program suitable for execution of the method of unlocking according to the present invention by the system of FIG. 3.

FIGS. 3 and 4 illustrate a microcomputer-based second embodiment of the system of the present invention. Microcomputer 100 includes a central processing unit (CPU) 101, a high-frequency clock pulse generator (CLOCK) 109, a read-only memory (ROM) 114, and a random-access memory (RAM) 111. CPU 101 receives inputs from switch 10 and clock 109, and counts and processes the signal durations as described later. ROM 114 holds the stored values of upper and lower limits (MAX and MIN, respectively) of the reference ratios Xo/Yo. RAM 11 serves as temporary storage for counted values, calculation procedures and results, and the like. CPU 101 is also connected to unlock actuator 17 in order to energize the same when the unlock coding is successfully performed by the driver, as described hereinafter.

FIG. 4 is a flowchart of a program which executes the method of the present invention on the system shown in FIG. 3. The program is started in response to a timing signal, such as an interrupt request signal generated at regular intervals or a low-frequency signal derived from the clock pulse signal. In this exemplary program, the counter values X and Y are initialized to zero, and the step counter is initialized to $-1$.

When the program of FIG. 4 starts, the status of the inputs from switch 10 is first checked at procedure 410. If switch 10 is off, the Y counter is incremented in procedure 420 and then checked in procedure 430 to see if it is now equal to one. If not, the program ends to wait for the next start signal. If Y does equal one, this implies that the switch has just been released, and accordingly, in procedure 440 the value of the X counter (on duration) is stored and the X counter is reset for the next step. The program control then ends.

If switch 10 is on in procedure 410, then the X counter is incremented and checked in procedure 460 to see if it is equal to one. If not, the program ends; if so, the switch has just been depressed to start a new coding step, and the step counter, corresponding to counter 16 in FIG. 1, is checked in procedure 470 to see if it is equal to $-1$. If so, this is the first step of a new unlocking attempt, and the step counter is incremented to zero in procedure 480. The program then ends. If in procedure 470 the step counter does not equal $-1$, then the value of the Y counter is stored and the Y counter is reset to zero in procedure 490. Then in procedure 500, the last stored X value is divided by the newly-stored Y value to obtain the on-off ratio for the last step. In procedure 510, the on-off ratio is compared with the upper limit value MAX stored in ROM 114 according to the current value of the step counter. If the on-off ratio is not less than MAX, the last coding step was incorrect, and so the step counter is reset to $-1$ in procedure 520 and the program ends. Otherwise, the on-off ratio is compared similarly to the lower limit value MIN in procedure 530. Again, if the on-off ratio is not greater than MIN, the step counter is reset in procedure 520 and the program ends. Otherwise, the last step was successfully performed and the step counter is incremented in procedure 540. In procedure 550, the value of the step counter is checked to see if it equals the predetermined number of coding steps N. If not, the program ends. If so, the entire unlock coding process has been successfully completed, and in procedure 560, the CPU outputs an energizing signal to actuator 17 in order to unlock the door.

The above-described program can be modified in a number of ways to achieve the same end. For example, the on-off ratio value can be appropriately rounded and then compared to a single reference value. Initialization and counter value handling can be performed in a variety of equally effective ways which will occur to one of skill in the art.

Furthermore, to avoid installing an additional push-button type switch 10 near the door, the door handle can be used to generate on-time and off-time interval signals. In this case, if an operator moves the door handle repeatedly in time with a musical rhythm, the door can be unlocked. In this case, since the switch 10 can be mounted inside the door panel, the switch 10 need not be visibly mounted on the outside surface of a door, so as to avoid spoiling the beauty of the door.

Furthermore, only the unlocking system according to the present invention has been disclosed herein. However, in order to lock, for instance, a door, it is possible to use another single switch to energize a locking actuator or else to design the door so as to be automatically and mechanically locked when the door is closed. Also, it is, of course, possible to use this unlocking system as a locking system.

As described above, in the electronic unlocking system according to the present invention, since the unlocking operation is achieved in response to switch-on and switch-off signals, only a single switch is necessary for the system; an operator can easily depress the switch; but other persons cannot easily find out how to depress the switch; therefore, the system is practical from the standpoint of crime prevention.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. An electronic unlocking system for operating an unlocking mechanism to unlock, for instance, a door, which comprises:

(a) a switch for generating an unlocking signal including a series of on-time intervals and off-time intervals when closed or opened manually;

(b) a first counting unit connected to said switch for counting respective time intervals during which said switch is kept turned on and outputting signals indicative of on-time interval values X;

(c) a second counting unit connected to said switch for counting respective time intervals during which said switch is kept turned off and outputting signals indicative of off-time interval values Y;

(d) a memory unit connected to said switch for storing respective reference values Xo/Yo and outputting the respective reference values in response to respective on-time signals output by said switch;

(e) a calculating unit connected to said first and second counting units for dividing respective numerical values X output by said first counting unit by respective numerical values Y output by said second counting unit and outputting signal indicative of respective divided values X/Y;

(f) a comparing unit connected to said calculating unit and said memory unit for comparing the respective numerical values X/Y calculated by said calculating unit to the respective reference values Xo/Yo stored in said memory unit and outputting signals whenever the respective calculated values X/Y agree with the respective reference values Xo/Yo;

(g) a third counting unit connected to said comparing unit for counting the number of the signals output by said comparing unit and outputting an unlocking command signal when the number counted by said third counting unit reaches a predetermined value; and (h) an unlocking actuator connected to said third counting unit for operating the unlocking mechanism when energized in response to the unlocking command signal output from said third counting unit, whereby an unlocking mechanism can be operated by repeatedly depressing and releasing a single switch in accordance with predetermined on-time and off-time interval relationships.

2. An electronic unlocking system for operating an unlocking mechanism to unlock, for instance, a door as set forth in claim 1, which further comprises:

(a) a clock pulse generating unit having:

(1) a reference oscillator for outputting a high frequency refrence clock pulse signal;

(2) a divider connected to said refrence oscillator for dividing the high frequency reference clock pulse signal into an appropriate low frequency reference clock pulse signal; and (3) a first AND gate having at least a pair of input terminals and an output terminal, one input terminal of which is connected to said divider; and (b) a timer connected to said switch and started by the leading edge of the respective on-time signal from said switch, said timer outputting a signal to the other input terminal of said first AND gate for a predetermined period of time to permit the transmission of the divided reference clock pulse signal from said divider to said first and second counting units, and said timer resetting said first and second counting units and said memory unit when started.

3. An electronic unlocking system for operating an unlocking mechanism to unlock, for instance, a door as set forth in claim 2, wherein said first counting unit comprises:

(a) a second AND gate, one input terminal of which is connected to said switch and the other input terminal of which is connected to the output terminal of said first AND gate; and (b) a first counter connected to said second AND gate for counting on-time intervals on the basis of the divided reference clock signal.

4. An electronic unlocking system for operating an unlocking mechanism to unlock, for instance, a door as set forth in claim 2, wherein said second counting unit comprises:

(a) a third AND gate, one inverted input terminal of which is connected to said switch and the other input terminal of which is connected to the output terminal of said first AND gate; and (b) a second counter connected to said third AND gate for counting off-time intervals on the basis of the divided reference clock signal.

5. An electronic unlocking system for operating an unlocking mechanism to unlock, for instance, a door as set forth in claim 1, wherein said memory unit comprises:

(a) a counter connected to said switch for counting the number of on-time signals from said switch and outputting signals indicative of memory addresses corresponding to the number of on-time signals;

(b) a subtracter connected to said counter for subtracting one from the memory address signals output by said counter and outputting signals corresponding thereto; and (c) a read-only memory connected to said subtracter for storing respective reference values Xo/Yo and outputting the respective stored reference values in response to the signals indicative of respective memory addresses numbers output by said subtracter.

6. An electronic unlocking system for operating an unlocking mechanism to unlock, for instance, a door as set forth in claim 5, wherein said calculating unit comprises;

(a) a first latch connected to said first counting unit and to said subtracter for receiving and recording the signals indicative of on-time interval values X counted by said first counting unit in response to the signal output by said subtracter and outputting the signals corresponding thereto;

(b) a timer connected to said subtracter for outputting signals for a predetermined period of time in response to the address signals from said subtracter;

(c) a first gate connected to said first latch and to said timer for outputting the signal recorded in said first latch only while said timer is operative;

(d) a second latch connected to said second counting unit and to said subtractor for receiving and recording the signals indicative of off-time interval values Y counted by said second counting unit in response to the signal output by said subtracter and outputting the signals corresponding thereto;

(e) a second gate connected to said second latch and to said timer for outputting the signal recorded in said second latch only while said timer is operative; and (f) a calculator connected to said first and second gates for dividing the respective values X output by said first gate by the respective values Y output by said second gate and outputting signals indicative of quotients X/Y.

7. An electronic unlocking system for operating an unlocking mechanism to unlock, for instance, a door as set forth in claim 6, wherein said comparing unit comprises comparator connected to said calculator and to said first read-only memory for comparing the numerical values X/Y calculated by said calculator with the respective reference values Xo/Yo stored in said read-only memory and outputting signals whenever the calculated values X/Y agree with the respective reference values Xo/Yo.

8. An electronic unlocking system for operating an unlocking mechanism to unlock, for instance, a door as set forth in claim 7, wherein said third counting unit comprises:

(a) a further counter connected to said comparator for counting the number of signals output by said comparator and outputting a signal when the counted number reaches a predetermined value, the signal from said further counter resetting said further counter itself and said first-mentioned counter;

(b) a further timer connected to said further counter and started by the signal output by said further counter for outputting an unlocking command signal for a predetermined period of time; and (c) an AND gate one input terminal of which is connected to said subtracter and a second, inverted, terminal of which is connected to said comparator, for outputting a signal indicative of a state wherein the counted values X and Y are both recorded in said first and second latches but the calculated value X/Y does not agree with the reference value thereby to reset said first-mentioned counter.

9. An electronic unlocking system for operating an unlocking mechanism to unlock, for instance, a door as set forth in claim 1, wherein said memory unit comprises:

(a) a counter connected to said switch for counting the number of on-time signals from said switch and outputting signals indicative of respective address numbers;

(b) a subtracter connected to said counter for subtracting one from the respective address numbers output by said counter and outputting signals corresponding thereto;

(c) a read-only memory connected to said subtracter for storing upper limits of respective calculated values X/Y and outputting the respective stored upper limit in response to a signal corresponding to the respective address output by said subtracter; and (d) a further read-only memory connected to said subtracter for storing lower limits of respective calculated values X/Y and outputting the respective stored lower limit in response to the signal corresponding to the respective address output by said subtracter.

10. An electronic unlocking system for operating an unlocking mechanism to unlock, for instance, a door as set forth in claim 5, wherein said calculating unit comprises;

(a) a first latch connected to said first counting unit and to said subtracter for receiving and recording the signals indicative of on-time interval values X counted by said first counting unit in response to the signal output by said subtracter and outputting the signals corresponding thereto;

(b) a timer connected to said subtracter for outputting signals for a predetermined period of time in response to the address signals from said subtracter;

(c) a first gate connected to said first latch and to said timer for outputting the signal recorded in said first latch only when said timer is operative;

(d) a second latch connected to said second counting unit and to said subtractor for receiving and recording the signals indicative of off-time interval values Y counted by said second counting unit in response to the signal output by said subtracter and outputting the signals corresponding thereto;

(e) a second gate connected to said second latch and to said timer for outputting the signal recorded in said second latch only while said timer is operative; and (f) a calculator connected to said first and second gates for dividing the values X said first gate by the respective values Y from said second gate and outputting signals indicative of quotients X/Y.

11. An electronic unlocking system for operating an unlocking mechanism to unlock, for instance, a door as set forth in claim 10, wherein said comparing unit comprises:

(a) a comparator connected to said calculator and to said read-only memory for comparing the values X/Y calculated by said calculator with respective upper limit values stored in said read-only memory and outputting signals whenever the calculated values X/Y are below the respective upper limit values; and (b) a further comparator connected to said calculator and to said further read-only memory for comparing the values X/Y calculated by said calculator with the respective lower limit values stored in said further read-only memory and outputting signals whenever the calculated values X/Y exceed the respective lower limit values.

12. An electronic unlocking system for operating an unlocking mechanism to unlock, for instance, a door as set forth in claim 11, wherein said third counting unit comprises:

(a) an AND gate, two input terminals of which are connected to said comparators, for outputting a signal whenever said comparators output signals indicative of the fact that the calculated value X/Y lies between the upper and lower limit values;

(b) a further counter connected to said AND gate for counting the number of signals output by said AND gate and outputting a signal when the counted number reaches a predetermined value, the signal from said further counter resetting said further counter itself and said first-mentioned counter;

(c) a further timer connected to said further counter and started by the signal output by said further counter for outputting an unlocking command signal for a predetermined period of time; and (d) a further AND gate one input terminal of which is connected to said subtracter and another inversion terminal of which is connected to said AND gate, for outputting a signal indicative of the fact that the counter values X and Y are both recorded in said first and second latches but the calculated value X/Y does not lie between the upper and lower limit values in order to reset said first-mentioned counter.

13. An electronic unlocking system for operating an unlocking mechanism to unlock, for instance, a door as set forth in claim 1, wherein said switch comprises a push-button switch.

14. An electronic unlocking system for operating an unlocking mechanism to unlock, for instance, a door as set forth in claim 1, wherein said switch is actuated by a door handle and is not exposed on the outer surface of the door.

15. An electronic unlocking system for operating an unlocking mechanism to unlock, for instance, a door as set forth in claim 1, wherein said unlocking actuator comprises a solenoid.

16. An electronic unlocking system for operating an unlocking mechanism to unlock, for instance, a door as set forth in claim 1, wherein said unlocking actuator comprises a motor.

17. A method for unlocking a door according to a predetermined coded rhythm, comprising the steps of:

(a) moving a switch between an on position and an off position to define a plurality of on intervals and off intervals;

(b) measuring the durations of each on interval and a corresponding off interval;

(c) determining the ratio of on duration to off duration for each on-off cycle of switch movement;

(d) comparing each determined on-off ratio to a corresponding predetermined ratio value; and (e) unlocking a door if a predetermined number of consecutive determined on-off ratios match the corresponding predetermined ratio values.

18. The method of claim 17, wherein in step (e), the door is unlocked if a predetermined number of consecutive determined on-off ratios equal the corresponding predetermined ratio values.

19. The method of claim 17, wherein in step (e), the door is unlocked if a predetermined number of consecutive determined on-off ratios fall within a predetermined range of the corresponding predetermined ratio values.

20. The method of claim 17, wherein said measuring step is performed by enabling a first counter to count constant-frequency clock pulses during the on interval and enabling a second counter to count clock pulses during the off interval, whereby the counted values of the two counters represent the desired duration values.

21. An electronic unlocking system as claimed in claim 1 wherein said first counting unit comprises a first counter connected to said switch for counting on-time intervals of said switch;

a second counter connected to said switch for counting off-time intervals of said switch;

a third counter connected to said switch for counting the number of on-time signals from said switch and outputting signals indicative of memory addresses corresponding to the number of on-time signals;

a subtracter connected to said third counter for subtracting one from the memory address signals output by said third counter and outputting signals corresponding thereto; and a first read-only memory connected to said subtracter for storing respective reference values Xo/Yo and outputting the respective stored reference values in response to the signals indicative of respective memory addresses numbers output by said subtracter.

22. An electronic unlocking system as claimed in claim 21 further comprising:

a first timer connected to said switch and started by the leading edge of the respective on-time signal from said switch; and wherein said calculating unit comprises:

(a) a first latch connected to said first counting unit and to said subtracter for receiving and recording the signals indicative of on-time interval values X counted by said first counting unit in response to the signal output by said subtracter and outputting the signals corresponding thereto;

(b) a second timer connected to said subtracter for outputting signals for a predetermined period of time in response to the address signals from said subtracter;

(c) a first gate connected to said first latch and to said second timer for outputting the signal recorded in said first latch only while said timer is operative;

(d) a second latch connected to said second counting unit and to said subtractor for receiving and recording the signals indicative of off-time interval values Y counted by said second counting unit in response to the signal output by said subtracter and outputting the signals corresponding thereto;

(e) a second gate connected to said second latch and to said second timer for outputting the signal recorded in said second latch only while said timer is operative; and (f) a calculator connected to said first and second gates for dividing the respective values X output by said first gate by the respective values Y output by said second gate and outputting signals indicative of quotients X/Y.

23. An electronic unlocking system as claimed in claim 22 wherein said comparing unit comprises a first comparator connected to said calculator and to said first read-only memory for comparing the numerical values X/Y calculated by said calculator with the respective reference values Xo/Yo stored in said first read-only memory and outputting signals whenever the calculated values X/Y agree with the respective reference values Xo/Yo, and wherein said third counting unit comprises:

a fourth counter connected to said first comparator for counting the number of signals output by said first comparator and outputting a signal when the counted number reaches a predetermined value, the signal from said fourth counter resetting said fourth counter itself and said first, second and third counters.

24. An electronic unlocking system as claimed in claim 23 wherein said third counting unit further comprises:

a third timer connected to said fourth counter and started by the signal output by said fourth counter for outputing an unlocking command signal for a predetermined period of time; and an AND gate one input terminal of which is connected to said subtracter and a second, inverted, terminal of which is connected to said first comparator, for outputting a signal indicative of a state wherein the counter values X and Y are both recorded in said first and second latches but the calculated value X/Y does not agree with the reference value thereby to reset said first, second and third counters.

25. An electronic unlocking system as claimed in claim 23 wherein said memory unit further comprises:

a second read-only memory connected to said subtracter for storing upper limits of respective calculated values X/Y and outputting the respective stored upper limit in response to a signal corresponding to the respective address output by said subtracter; and a third read-only memory connected to said subtractor for storing lower limits of respective calculated values X/Y and outputting the respective stored lower limit in response to the signal corresponding to the respective address output by said 26. An electronic unlocking system as claimed in claim 25 wherein said comparing unit further comprises:

a second comparator connected to said calculator and to said second read-only memory for comparing the values X/Y calculated by said calculator with respective upper limit values stored in said second read-only memory and outputting signals whenever the calculated values X/Y are below the respective upper limit values; and a third comparator connected to said calculator and to said third read-only memory for comparing the values X/Y calculated by said calculator with the respective lower limit values stored in said third read-only memory and outputting signals whenever the calculated values X/Y exceed the respective lower limit values.

27. An electronic unlocking system as claimed in claim 26 wherein said third counting unit comprises:

(a) an AND gate, two input terminals of which are connected to said second and third comparators, respectively, for outputting a signal whenever said second and third comparators output signals indicative of the fact that the calculated value X/Y lies between the upper and lower limit values;

(b) said fourth counter connected to said AND gate for counting the number of signals output by said AND gate and outputting a signal when the counted number reaches a predetermined value, the signal from said fourth counter resetting said fourth counter itself and said first, second, and third counters;

(c) a third timer connected to said fourth counter and started by the signal output by said fourth counter for outputting an unlocking command signal for a predetermined period of time;

(d) a second AND gate one input terminal of which is connected to said subtracter; a second, inverted, terminal of which is connected to said first comparator, and a third inverted terminal of which is connected to said fourth AND gate, for outputting a signal indicative of a state wherein the counted values X and Y are both recorded in said first and second latches but the calculated value X/Y does not agree with the reference value therefor in the first read-only memory and does not lie in a range defined by the upper and lower limits stored in said second and third read-only memories.

* * * * *